US006775494B2

(12) United States Patent
Kusaba et al.

(10) Patent No.: US 6,775,494 B2
(45) Date of Patent: Aug. 10, 2004

(54) PROCESS CARTRIDGE, IMAGE FORMING APPARATUS AND INTERMEDIATE TRANSFER BELT

(75) Inventors: Takashi Kusaba, Shizuoka (JP); Hiroyuki Kobayashi, Shizuoka (JP); Akihiko Nakazawa, Shizuoka (JP); Atsushi Tanaka, Shizuoka (JP); Tsunenori Ashibe, Kanagawa (JP); Hidekazu Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 10/081,205

(22) Filed: Feb. 25, 2002

(65) Prior Publication Data

US 2002/0159789 A1 Oct. 31, 2002

(30) Foreign Application Priority Data

Feb. 28, 2001 (JP) ..... 2001/056020

(51) Int. Cl.[7] ..... G03G 21/16
(52) U.S. Cl. ..... 399/111
(58) Field of Search ..... 399/25, 107, 110, 399/111, 202, 308

(56) References Cited

U.S. PATENT DOCUMENTS

| | | | | |
|---|---|---|---|---|
| 4,873,548 | A | 10/1989 | Kobayashi et al. | 399/111 |
| 5,116,711 | A | 5/1992 | Kobayashi et al. | 430/106 |
| 5,149,610 | A | 9/1992 | Kobayashi et al. | 430/106 |
| 5,164,275 | A | 11/1992 | Kobayashi et al. | 430/45 |
| 5,256,512 | A | 10/1993 | Kobayashi et al. | 430/106 |
| 5,331,373 | A | 7/1994 | Nomura et al. | 399/111 |
| 5,440,373 | A | 8/1995 | Deki et al. | 399/113 |
| 5,446,525 | A | 8/1995 | Kobayashi | 399/111 |
| 5,452,056 | A | 9/1995 | Nomura et al. | 399/111 |
| 5,585,889 | A | 12/1996 | Shishido et al. | 399/113 |
| 5,585,902 | A | 12/1996 | Nishiuwatoko et al. | 399/106 |
| 5,587,769 | A | 12/1996 | Sawada et al. | 399/113 |
| 5,713,067 | A | 1/1998 | Mizoe et al. | 399/176 |
| 5,752,131 | A | 5/1998 | Fujiwara et al. | 399/106 |
| 5,802,427 | A | 9/1998 | Sawada et al. | 399/122 |
| 5,870,654 | A | 2/1999 | Sato et al. | 399/109 |
| 5,966,566 | A | 10/1999 | Odagawa et al. | 399/109 |
| 6,493,528 | B2 * | 12/2002 | Sameshima et al. | 399/111 |

FOREIGN PATENT DOCUMENTS

| | | |
|---|---|---|
| JP | 63-301960 | 12/1988 |
| JP | 6-110261 | 4/1994 |
| JP | 8-137181 | 5/1996 |
| JP | 9-80934 | 3/1997 |
| JP | 10-177329 | 6/1998 |
| JP | 11-30944 | 2/1999 |

* cited by examiner

*Primary Examiner*—Hoan Tran
(74) *Attorney, Agent, or Firm*—Fitzpatrick, Cella, Harper & Scinto

(57) ABSTRACT

A process cartridge integrally supports therein a cylindrical latent-image-bearing member on which a toner image is formed and an intermediate transfer belt to which the toner image is primarily transferred and from which it is secondarily transported to a transfer medium. To prevent the latent-image-bearing member from being unwantedly triboelectrically charged during transportation, the cartridge satisfies any of requirements that A) the latent-image-bearing member has a surface potential Vt of −200 V≦Vt≦200 V when the intermediate transfer belt and the latent-image-bearing member are rubbed with each other, B) a spacer member is provided between the intermediate transfer belt and the latent-image-bearing member, and the latent-image-bearing member has a surface potential Vt of −200 V≦Vt≦200 V when the former and the latter are rubbed with each other, and C) the cartridge has a device for lowering contact pressure of the intermediate transfer belt against the latent-image-bearing member.

23 Claims, 7 Drawing Sheets

PROCESS CARTRIDGE, IMAGE FORMING APPARATUS AND INTERMEDIATE TRANSFER BELT

BACKGROUND OF THE INVENTION

1. Field of the Invention

This invention relates to a process cartridge having a latent-image-bearing member on the surface of which a toner image is to be formed and an intermediate transfer belt which are integrally provided, an image-forming apparatus having such a process cartridge, and an intermediate transfer belt of the process cartridge.

2. Related Background Art

Image-forming apparatus making use of an intermediate transfer belt, which is a beltlike intermediate transfer member, are effective as full-color image-forming apparatus and multi-color image-forming apparatus in which a plurality of color timer images are sequentially superimposingly transferred to a transfer medium to output an image-formed material.

Compared with a transfer system as disclosed in Japanese Patent Application Laid-Open No. 63-301960, i.e., an image-forming apparatus in which toner images are transferred from an electrophotographic photosensitive member serving as a first image-bearing member to a transfer medium as a second image-bearing member, fastened or attracted onto a transfer drum, the above image-forming apparatus have an advantage that a variety of transfer media can be selected without regard to their width and length, including thin paper (40 g/m$^2$ paper) and up to thick paper (200 g/m$^2$ paper) such as envelopes, post cards and labels. This is because the use of the intermediate transfer belt makes any processing or control (e.g., the transfer medium is held with a gripper, attracted, and made to have a curvature) unnecessary for the transfer medium.

In addition, the intermediate transfer member made in the shape of a belt enables effective utilization of space to make the apparatus main body compact and achieve cost reduction, because the freedom in disposing it inside the image-forming apparatus can be greater than a case in which a rigid cylinder, such as an intermediate transfer drum, is used.

However, in usual cases the intermediate transfer belt has a shorter lifetime than the apparatus main body, and hence, under the existing conditions, it is indispensable to replace the belt in the middle of the use of apparatus. It is also necessary to dispose of the developer (hereinafter often "toner") having remained on the intermediate transfer belt. In addition to these disadvantages, it is necessary to replace many component parts such as a latent-image-bearing member, a developing assembly and a developer.

As a method of making these replacement parts into a unit or units so as to be attached to or detached from the main body with ease, it is proposed as disclosed in Japanese Patent Application Laid-Open No. 8-137181 that the intermediate transfer belt and the latent-image-bearing member are made into units independent from each other and are so placed as to be attached to or detached from the main body with ease.

However, such a means requires replacement units in a large number and makes user's operation troublesome. Also, since the units are designed and placed independently from each other, a problem may arise such that the apparatus must be made large-sized and may involve a high cost.

As a means for solving such a problem, as disclosed in Japanese Patent Applications Laid-Open No. 6-110261, No. 10-177329 and No. 11-30944, a means is proposed in which the intermediate transfer belt and the latent-image-bearing member are made into one unit so as to be simultaneously attached to or detached from the main body and replaced.

However, as being different from a case in which the intermediate transfer belt is set at the time the apparatus main body is installed, such a method in which the intermediate transfer belt and the latent-image-bearing member are set up as one unit to provide a process cartridge which can be attached to or detached from the main body with ease tends to cause some problems due to the fact of making them into one unit. One of them is the problem that the latent-image-bearing member may be triboelectrically charged because of any vibration such an intermediate transfer belt/latent-image-bearing member integral cartridge (process cartridge) may undergo during distribution in the market. Once the latent-image-bearing member has been triboelectrically charged because of such vibration during distribution, the latent-image-bearing member may change in characteristics to cause density differences in the images to be reproduced.

In particular, with progress of techniques for image-forming apparatus in recent years, it has become possible for digital-development type printers and copying machines to develop minute and accurate latent images with a resolution of 600 dpi or more as exposure spots have been made smaller in size and more highly dense, and in addition thereto to obtain images with a high quality level on account of, e.g., precise control of electric fields. As the result, such unauthorized triboelectric charging of latent-image-bearing members during distribution that has not come into question in the past may also greatly affect image quality, and it is an important subject to solve this problem. This problem may especially remarkably occur when the latent-image-bearing member has a cylindrical rigid body as its support, because the intermediate transfer belt and the latent-image-bearing member tend to come into contact with each other with a stronger force than when the latent-image-bearing member is in the form of a belt. Moreover, this problem may much more remarkably occur when the latent-image-bearing member has an outer diameter of 50 mm or less.

In all the above proposals, however, any measure is taken against the triboelectric charging of latent-image-bearing members because of the vibration during distribution in the state they are taken out of the image-forming apparatus, and it can not be said that any apparatus have been designed taking distribution channels into account. Hence, there occur problems that the management cost may increase because of, e.g., any restriction on how to handle process cartridges after manufacture and that complaints from users may increase.

In addition to these, it is also an important subject to reduce running cost, and much more cost reduction must be achieved on the intermediate transfer belt and intermediate transfer belt/latent-image-bearing member integral cartridge which come to be replacement parts. Also, in order to make them easy to handle, the miniaturization and the disposal of waste toner must well be taken into consideration.

SUMMARY OF THE INVENTION

Accordingly, an object of the present invention is to provide a process cartridge, an image-forming apparatus and an intermediate transfer belt which promise easy maintenance, enable miniaturization and cost reduction of the apparatus, and yet can prevent any faulty images from being caused by the unauthorized triboelectric charging of latent-image-bearing members during distribution, and produce good images even when they are transported or left over a long period of time.

To achieve the above object, the present invention first provides a process cartridge which is detachably mountable to the main body of an image-forming apparatus; the process cartridge integrally comprising:

a latent-image-bearing member having a cylindrical rigid body as a support, on the surface of which an electrostatic latent image is formed and the electrostatic latent image is developed to form a toner image; and an intermediate transfer belt to which the toner image formed on the latent-image-bearing member is primarily transferred and on which the toner image is held and transported to transfer the toner image secondarily to a transfer medium;

the latent-image-bearing member having a surface potential Vt of $-200\ V \leqq Vt \leqq 200\ V$ when the intermediate transfer belt and the latent-image-bearing member are rubbed with each other.

The present invention, second, provides a process cartridge which is detachably mountable to the main body of an image-forming apparatus, the process cartridge integrally comprising:

a latent-image-bearing member having a cylindrical rigid body as a support, on the surface of which an electrostatic latent image is formed and the electrostatic latent image is developed to form a toner image;

an intermediate transfer belt to which the toner image formed on the latent-image-bearing member is primarily transferred and on which the toner image is held and transported to transfer the toner image secondarily to a transfer medium; and a spacer member being provided between the intermediate transfer belt and the latent-image-bearing member, and the latent-image-bearing member having a surface potential Vt of $-200\ V \leqq Vt \leqq 200\ V$ when the spacer member and the latent-image-bearing member are rubbed with each other.

The present invention, third, provides a process cartridge which is detachably mountable to the main body of an image-forming apparatus, the process cartridge integrally comprising:

a latent-image-bearing member having a cylindrical rigid body as a support, on the surface of which an electrostatic latent image is formed and the electrostatic latent image is developed to form a toner image; and an intermediate transfer belt to which the toner image formed on the latent-image-bearing member is primarily transferred and on which the toner image is held and transported to transfer the toner image secondarily to a transfer medium, the process cartridge having a means for lowering the contact pressure of the intermediate transfer belt against the latent-image-bearing member, to lower the contact pressure of the intermediate transfer belt against the latent-image-bearing member when the process cartridge is transported.

The present invention also provides an image-forming apparatus having the above process cartridge, and an intermediate transfer belt of the process cartridge.

DETAILED DESCRIPTION OF THE INVENTION

The process cartridge of the present invention is detachably mountable to the main body of an image-forming apparatus, and i) a latent-image-bearing member having a cylindrical rigid body as a support, on the surface of which an electrostatic latent image is formed and the electrostatic latent image is developed to form a toner image and ii) an intermediate transfer belt to which the toner image formed on the latent-image-bearing member is primarily transferred and on which the toner image is held and transported to transfer the toner image secondarily to a transfer medium are integrally supported therein as one unit. It further satisfies any of the following requirements A to C.

A. The latent-image-bearing member has a surface potential Vt of $-200\ V \leqq Vt \leqq 200\ V$ when the intermediate transfer belt and the latent-image-bearing member are rubbed with each other.

B. A spacer member is provided between the intermediate transfer belt and the latent-image-bearing member, and the latent-image-bearing member has a surface potential Vt of $-200\ V \leqq Vt \leqq 200\ V$ when the spacer member and the latent-image-bearing member are rubbed with each other.

C. The process cartridge has a means for lowering contact pressure of the intermediate transfer belt against the latent-image-bearing member, to lower the contact pressure of the intermediate transfer belt against the latent-image-bearing member when the process cartridge is transported.

The process cartridge, image-forming apparatus and intermediate transfer belt according to the present invention are described below in greater detail with reference to the accompanying drawings.

An example of an image-forming apparatus having the process cartridge of the present invention is described with reference to FIG. 1.

Figure 1:
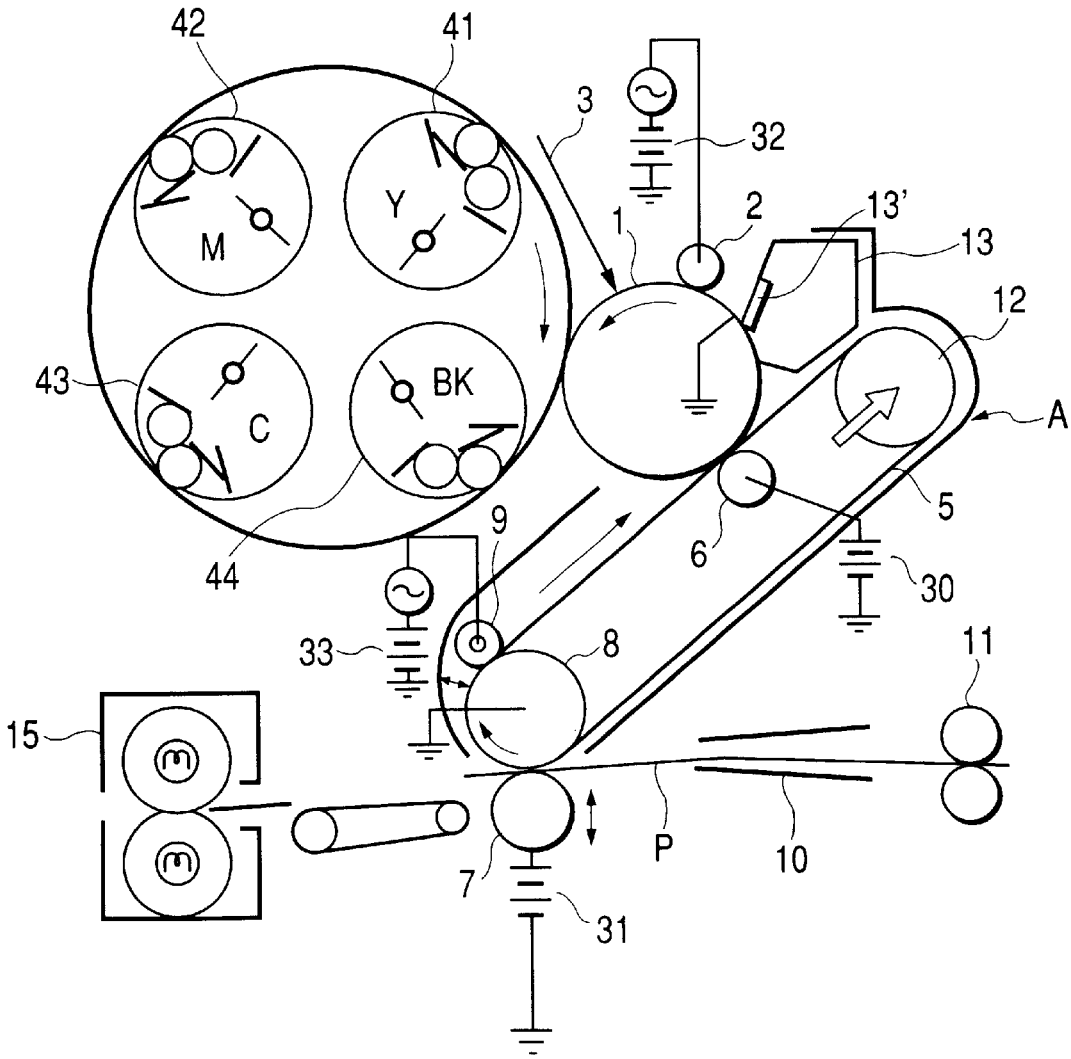
FIG. 1 is a schematic sectional view showing an example of the image-forming apparatus of the present invention.

FIG. 1 is a schematic sectional view of a full-color image forming apparatus such as a copying machine or a laser beam printer, utilizing an electrophotographic process. In this embodiment, an intermediate transfer belt/latent-image-bearing member integral cartridge which has an intermediate transfer belt and a latent-image-bearing member (electrophotographic photosensitive member) formed integrally and is detachably mountable to the main body of the image-forming apparatus is provided as the process cartridge. Also, this image-forming apparatus is of a digital system which forms latent images with a resolution of 600 dpi or more.

This image-forming apparatus has a cylindrical latent-image-bearing member (hereinafter also "photosensitive drum") 1 used repeatedly as a first image-bearing member.

The photosensitive drum 1 comprises an aluminum cylinder as the cylindrical rigid body and has a photosensitive layer formed thereon, and is rotatingly driven at a prescribed peripheral speed (process speed) in the direction of an arrow.

The photosensitive drum 1 is, in the course of its rotation, uniformly charged to prescribed polarity and potential by means of a primary-charging assembly 2 connected to a power source 32. As a bias applied from the primary-charging assembly power source 32 to the primary-charging assembly 2, a bias formed by superimposing an alternating current on a direct current is used here. Only a direct-current voltage may be used. Subsequently, the photosensitive drum is subjected to imagewise exposure 3 by a exposure means (not shown; e.g., a color original image color-separating/image-forming optical system, or a scanning exposure system comprising a laser scanner that outputs laser beams modulated in accordance with time-sequential electrical digital pixel signals of image information). Thus, an electrostatic latent image is formed which corresponds to a first color component image (e.g., a yellow color component image) of the intended color image.

Next, the electrostatic latent image is developed with a first-color yellow toner Y by means of a first developing assembly (yellow color developing assembly 41) to produce a yellow visible image, i.e., a yellow toner image. In the course of forming the yellow toner image, second to fourth developing assemblies (magenta color developing assembly 42, cyan color developing assembly 43 and black color developing assembly 44) each stand unoperated and do not act on the photosensitive drum 1, and hence the first-color yellow toner image is not affected by the second to fourth developing assemblies.

The yellow toner image formed on the photosensitive drum 1 is first primarily transferred to an intermediate transfer member which is a second image-bearing member. Here, the intermediate transfer member is a beltlike, intermediate transfer belt 5. The intermediate transfer belt 5 is rotatingly driven in the clockwise direction as viewed in FIG. 1, coming into contact with the photosensitive drum 1 at a prescribed width and at the same peripheral speed. Also, on the inside of the intermediate transfer belt 5, a primary-transfer roller 6 is disposed which is a primary-transfer means to which a primary-transfer bias is applied. Reference numeral 8 and 12 are tension rollers, which will be detailed later.

On the intermediate transfer belt 5, an electric field is formed by a primary-transfer bias applied from the primary-transfer roller 6 which is the primary-transfer means disposed on the inside of the belt. The first-color yellow toner image formed and held on the photosensitive drum 1 passes through a contact zone formed between the photosensitive drum 1 and the intermediate transfer belt 5, and is primarily transferred to the outer periphery of the intermediate transfer belt 5.

The photosensitive drum 1 surface from which the corresponding first-color yellow toner image has been transferred to the intermediate transfer belt 5 is cleaned by a cleaning assembly 13 having a blade 13'.

Then, subsequently thereto, the second-color magenta toner image, the third-color cyan toner image and the fourth-color black toner image are sequentially likewise transferred superimposingly onto the intermediate transfer belt 5. Thus, a synthesized color toner image corresponding to the intended color image is formed on the intermediate transfer belt 5.

The primary transfer bias for sequentially superimposingly transferring the first- to fourth-color toner images from the photosensitive drum 1 to the intermediate transfer belt 5 is applied from the primary-transfer roller 6 connected to a bias power source 30 in a polarity (+) reverse to that of each toner. The voltage thus applied may preferably be in the range of from +100 V to +2 kV. If the applied voltage is lower than +100 V, any stable primary transfer can not be performed. If it is higher than 2 kV, the power source may involve a high cost and at the same time the intermediate transfer belt and photosensitive drum tend to undergo insulation breakdown. Also, the transfer roller 6 may preferably be in contact with the photosensitive drum 1 at a contact pressure of from 0.01 to 1 N/cm, and particularly preferably from 0.1 to 0.5 N/cm. If the contact pressure is lower than 0.01 N/cm, a stable contact zone may be formed with difficulty between the intermediate transfer belt and the photosensitive drum, and hence images tends to be formed in an uneven density. Meanwhile, when a bias cleaning method described later is employed as a method of cleaning the intermediate transfer belt, good cleaning performance may be achieved with difficulty. If, on the other hand, the contact pressure is higher than 1 N/cm, not only the photosensitive drum tends to be charged at a high potential, but also any good cleaning performance can not be achieved in some cases because the toner having remained on the intermediate transfer belt is strongly pressed against the intermediate transfer belt.

The synthesized color toner image thus transferred to the intermediate transfer belt 5 is then secondarily transferred at one time to a transfer medium P such as recording paper which is a third image-bearing member. As a secondary-transfer means, a secondary-transfer roller 7 is provided in such a way that it is axially supported in parallel to a drive roller 8 and stands separable from the bottom surface of the intermediate transfer belt 5. In the step of primarily transferring the first- to third-color toner images from the photosensitive drum 1 to the intermediate transfer belt 5, the secondary-transfer roller 7 may also be made to stand separate from the intermediate transfer belt 5.

The synthesized color toner image transferred to the intermediate transfer belt 5 is transferred to the third image-bearing member transfer medium P in the following way: The secondary transfer roller 7 is brought into contact with the intermediate transfer belt 5 and simultaneously the transfer medium P is fed at a prescribed timing from a paper feed roller 11 through a transfer medium guide 10 to the contact zone formed between the intermediate transfer belt 5 and the secondary-transfer roller 7, where a secondary-transfer bias is applied to the secondary-transfer roller 7 from a power source 31. Upon application of this secondary-transfer bias, the synthesized color toner image is secondarily transferred from the intermediate transfer belt 5 to the third image-bearing member transfer medium P.

The transfer medium P to which the synthesized color toner image has been transferred is guided into a fixing assembly 15 and is heat-fixed there.

After the synthesized color toner image has been transferred to the transfer medium P, a charging member 9 for cleaning, disposed separably, is brought into contact with the intermediate transfer belt 5, and a bias with a polarity reverse to that of the photosensitive drum 1 is applied from a power source 33, whereupon electric charges with a polarity reverse to that at the time of primary transfer are imparted to toners not transferred to the transfer medium P and remaining on the intermediate transfer belt 5 (transfer residual toners). Here, the bias power source 33, from which the cleaning bias is applied to the charging member 9 for cleaning, is applied in the state that an alternating current is superimposed to a direct current. The transfer residual toners charged to the polarity reverse to that at the time of primary transfer are electrostatically transferred to the photosensitive drum 1 at the contact zone formed between the intermediate transfer belt 5 and the photosensitive drum 1 and the vicinity thereof, thus cleaning the intermediate transfer belt 5. In such a mechanism for cleaning the intermediate transfer belt (hereinafter also "bias cleaning method"), the intermediate transfer belt 5 can be cleaned simultaneously with the primary transfer, and hence the though-put does not decrease.

Figure 2:
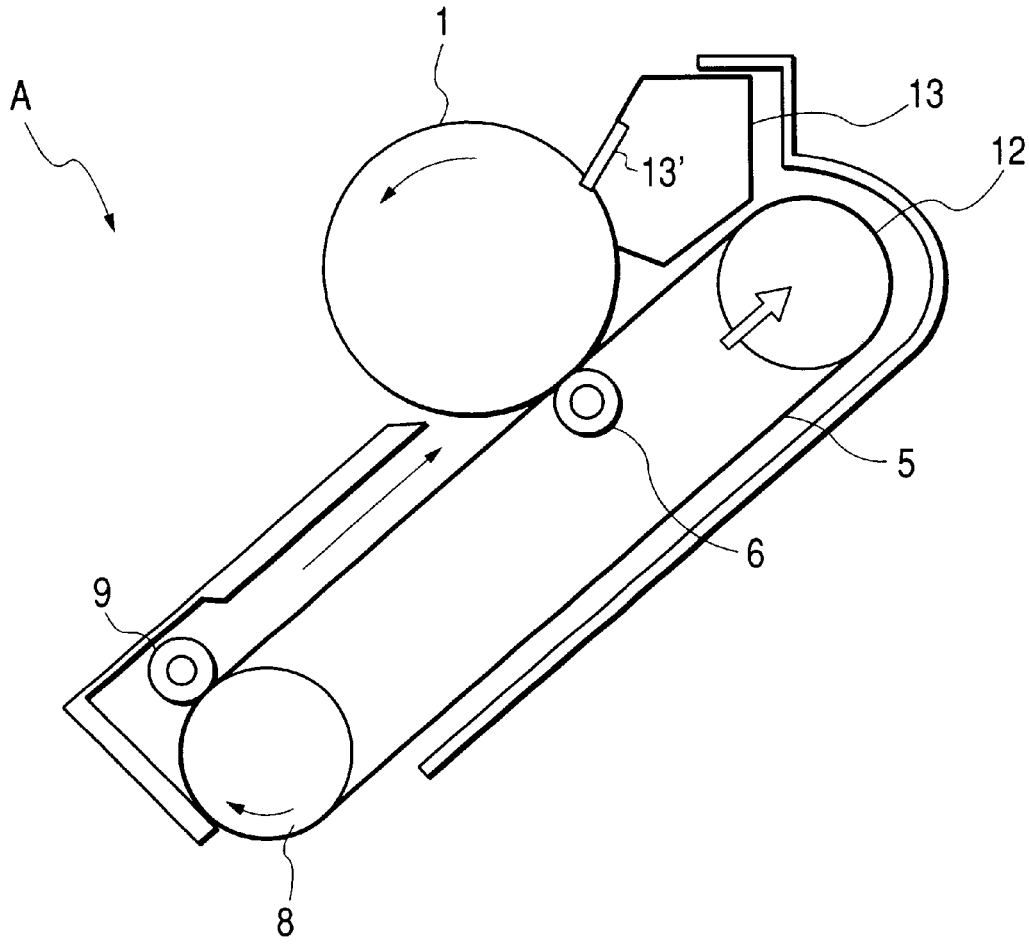
FIG. 2 is a schematic sectional view showing an example of the process cartridge of the present invention.

In the image-forming apparatus shown in FIG. 1, an intermediate transfer belt/latent-image-bearing member integral cartridge A shown in FIG. 2, comprising the above intermediate transfer belt 5 and the above photosensitive drum 1, is detachably mountable to the main body of the image-forming apparatus. Thus, it has a construction having superior maintenance performance.

The intermediate transfer belt/latent-image-bearing member integral cartridge of the present invention is described below. In the cartridge A shown in FIG. 2 as one embodiment, an intermediate transfer belt 5, a photosensitive drum, latent-image-bearing member 1, a cleaning mechanism 9 for the intermediate transfer belt and a cleaning mechanism 13 for the latent-image-bearing member 1 constitute one unit integrally so that it is detachably mountable to the main body.

The cleaning of the intermediate transfer belt 5 is necessary for the transfer residual toners to be charged to a polarity reverse to that of primary transfer by the charging member 9 for cleaning as described previously and thereby returned to the latent-image-bearing member 1 the primary-transfer zone. In the cartridge shown in FIG. 1, a cleaning roller 9 comprised of a medium-resistance elastic body is provided as the cleaning mechanism 9. The cleaning of the latent-image-bearing member 1 is performed by a blade 13' fitted to a cleaning container 13 and provided in contact with the latent-image-bearing member 1. In this cartridge, a waste-toner container (not shown) is also integrally provided so that the transfer residual toners on both the intermediate transfer belt 5 and the latent-image-bearing member 1 can simultaneously be discarded when the cartridge A is replaced. Thus, it contributes to an improvement in maintenance performance.

The intermediate transfer belt 5 is also put over two rollers, tension rollers 8 and 12 so that the number of component parts can be made small and the cartridge can be made compact. Here, the tension roller 8, which is provided on the side upstream with respect to the position of the latent-image-bearing member 1, is a drive roller and at the same time an opposing roller of the cleaning roller 9 and, when the cartridge A is attached to the image-forming apparatus main body, an opposing roller of the secondary-transfer roller 7. The tension roller 12, which rotates to follow the intermediate transfer belt 5, has a sliding mechanism, and is brought into pressure contact with the inside of the belt in the direction of an arrow by the action of a compression spring to impart a tension to the intermediate transfer belt 5. It may preferably be slidable with a slide width of from 1 to 20 mm. If the slide width is smaller than 1 mm, the tension of the belt may no longer be ensured when the intermediate transfer belt 5 comes to elongate because of creep, tending for the belt to be unstably driven. If it is larger than 20 mm, the cartridge may have to be in a larger size undesirably. Also, the spring may preferably apply a pressure of from 5 to 200 N, and particularly preferably from 5 to 100 N, and further preferably from 5 to 30 N, in total. If the spring pressure is lower than 5 N, the belt can not be stably driven in some cases because of an insufficient friction with a drive roller for driving the belt. A pressure higher than 200 N is not preferable because too large a torque may be required for driving the belt. Still also, the spring pressure may influence the shape of the contact zone formed between the intermediate transfer belt and the photosensitive drum. Hence, unless it is within the proper range, images tend to be formed in an uneven density, or good cleaning performance may be achieved with difficulty. Also, the latent-image-bearing member 1 and the drive roller 8 have a coupling (not shown) between them so that the rotational driving force is transmitted.

In the present invention, the latent-image-bearing member 1 has a surface potential Vt of $-200\ V \leqq Vt \leqq 200\ V$ when the intermediate transfer belt 5 and the latent-image-bearing member 1 are rubbed with each other. If it has an absolute value of Vt of more than 200 V, the latent-image-bearing member may change in characteristics to cause density differences in the images to be reproduced. The Vt may particularly preferably be $-100\ V \leqq Vt \leqq 100\ V$. It may further preferably be $0\ V \leqq Vt \leqq 100\ V$ from the viewpoint of the selection of materials for surface layers of the intermediate transfer belt and photosensitive drum taking account of good transfer performance and cleaning performance.

The relationship of characteristics between the intermediate transfer belt 5 and the latent-image-bearing member 1 is greatly influenced by the constitution of surface layers of both the member 1 and the belt 5. Stated more specifically, it may involve various factors such as the types of resins used in the surface layers, the types of additives, the ratio of quantity of these, the state of dispersion and also the shape. In the present invention, what is important is that the relationship of characteristics between the intermediate transfer belt 5 and the latent-image-bearing member 1 falls within the above range. There are no particular limitations on the means by which it is achieved. There, however, are preferred combinations, which will be detailed later.

The intermediate transfer belt 5 may also preferably have a surface roughness Ra of 1 $\mu$m or less. If it has a surface roughness Ra of 1 $\mu$m or more, the transfer performance may be affected to cause course halftone images or a lowering of fine-line reproducibility. Especially when the bias cleaning method is used as the method of cleaning the intermediate transfer belt 5, the electric charges imparted to the secondary-transfer residual toners may become non-uniform, or intermediate transfer belt faulty cleaning may occur in which the secondary-transfer residual toners are not well returned to the latent-image-bearing member 1 to cause a difficulty that previous images remain on images subsequently printed at the time of continuous printing. In particular, this image problem may remarkably occur in the image-forming apparatus of a digital system with a resolution of 600 dpi or more as in this embodiment.

In the present invention, there are also no particular limitations on the means by which the surface roughness of the intermediate transfer belt 5 is regulated. For example, a method is available which makes regulation in such a way that, when extrusion is carried out, melt properties of resin materials used are selected and temperature conditions and cooling conditions at the time of molding are regulated so that more smooth surface can be attained when an extruded product, melt-extruded into a film, is solidified from a molten state. Another method is also available in which a product extruded into a belt is heated applying a smooth form (for shaping) to work the product so as to have the same surface state as that of the form, or a method in which the surface of a belt is polished.

The intermediate transfer belt 5 may also preferably be made to have a volume resistivity in the range of from $10^6$ Ω.cm to $8\times10^{13}$ Ω.cm, by, e.g., controlling the quantity of a conductive filler. If it has a volume resistivity lower than $10^6$ Ω.cm, its resistance is too low to provide a sufficient transfer electric field with ease, tending to cause blank areas in images or coarse images. If on the other hand it has a volume resistivity higher than $8\times10^{13}$ Ω.cm, the transfer voltage must also be made higher, requiring the power source to be in a large size or resulting in a higher cost.

The intermediate transfer belt 5 may also have a thickness in the range of from 40 μm to 300 μm. If it has a thickness smaller than 40 μm, it may lack in extrusion stability, tends to cause uneven thickness and may have an insufficient durability and strength, where the belt may break or crack. If on the other hand it has a thickness larger than 300 μm, materials must be used in a large quantity, resulting in a high cost. Moreover, the intermediate transfer belt may have a large difference in peripheral speed between the inner surface and the outer surface of the belt at its part where it is put over the shaft of a printer or the like, tending to cause problems of, e.g., spots around line images due to the expansion and contraction of the outer surface. The belt may also have a low flex durability or have so high a rigidity as to make the drive torque greater, requiring the main body to be in a large size or resulting in a higher cost. Such a problem also tends to occur.

The intermediate transfer belt/latent-image-bearing member integral cartridge A in this embodiment may have an intermediate transfer belt 5 produced by the following process. The present invention is by no means limited by this process.

The process for producing the intermediate transfer belt 5 may preferably be a production process which can produce a seamless belt and also has so high a production efficiency as to enable cost saving. As a means therefor, a method is available in which an extrusion material is continuously melt extruded from a circular die and thereafter the product thus extruded is cut in any necessary length to produce a belt. For example, blown-film extrusion (inflation) is preferred.

Figure 3:
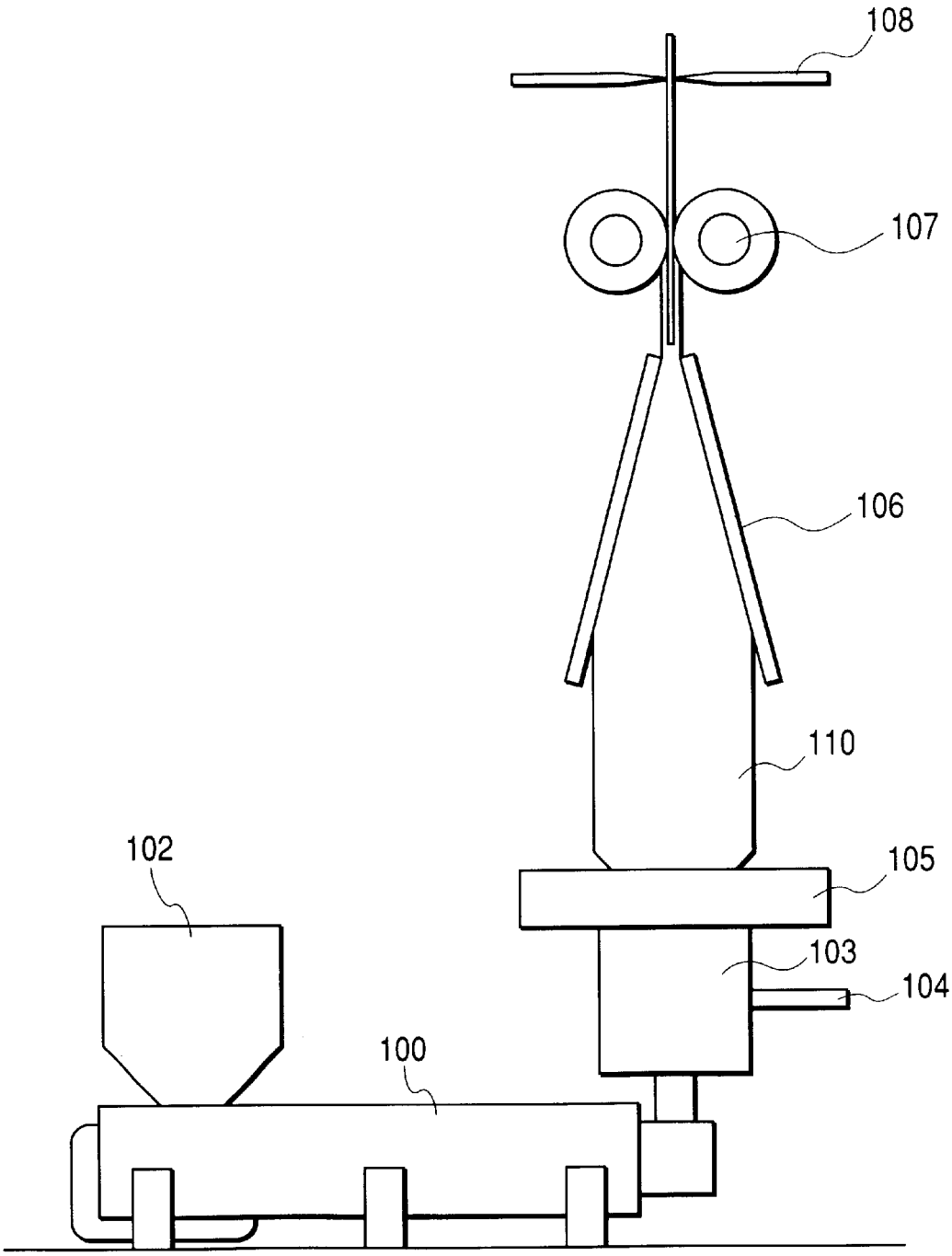
FIG. 3 is a schematic view showing an example of a production unit used to produce the intermediate transfer belt of the present invention.

FIG. 3 shows an extrusion apparatus employing a blown-film extrusion method according to the present invention. This apparatus consists basically of an extruder 100, an extruder die 103 and a gas blowing unit 104.

First, an extrusion resin, a conducting agent and additives are premixed under the desired formulation and thereafter kneaded and dispersed to prepare an extrusion material, which is then put into a hopper 120 installed to the extruder 100. The extruder 100 has a preset temperature, extruder screw construction and so forth which have been so selected that the extrusion material may have a melt viscosity necessary for enabling the extrusion into a belt in the post step and also the materials can be dispersed uniformly one another. The extrusion material is melt-kneaded in the extruder 10 into a melt, which then enters a circular die 103. The circular die 103 is provided with a gas inlet passage 104. Through the gas inlet passage 104, a gas is blown into the circular die 103, whereupon the melt having passed through the circular die 103 in a tubular form inflates while scaling up in the diametrical direction.

The gas to be blown here may be air in the atmosphere, and besides, may be selected from nitrogen, carbon dioxide and argon. The extruded product having thus inflated is drawn upward while being cooled by an outside-cooling ring 105 attached to the circular die 103, and formed into a tubular film 110. Usually, in such a blown-film extrusion apparatus, a method is employed in which the tubular film 110 is pressed forcibly from the right and the left by means of stabilizing plates 106 to fold it into a sheet, and then drawn off at a constant speed while being so sandwiched with pinch rollers 107 that the air in the interior does not escape. Then, the film 110 thus drawn off is cut with a cutter 108 to obtain a tubular film with the desired size.

Next, this tubular film is worked using a form (for shaping) in order to regulate its surface smoothness and size and to remove any folds made in the film at the time of draw-off.

Figure 4B:
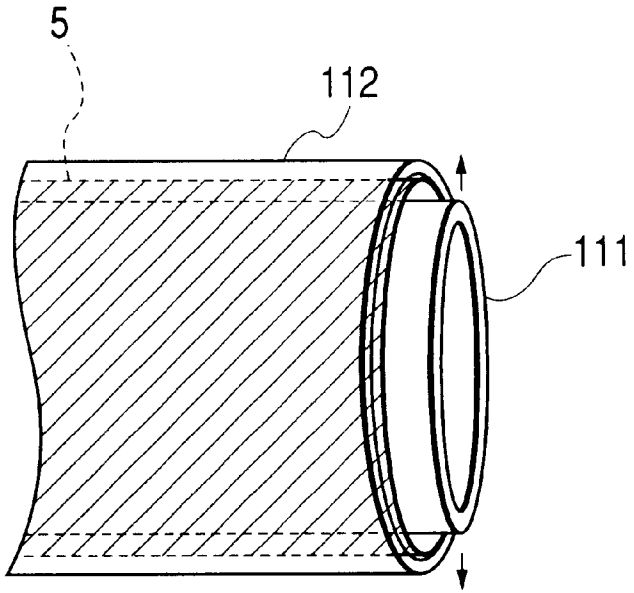
FIGS. 4A and 4B are schematic views illustrating a method of form-working the intermediate transfer belt of the present invention.
Figure 4A:
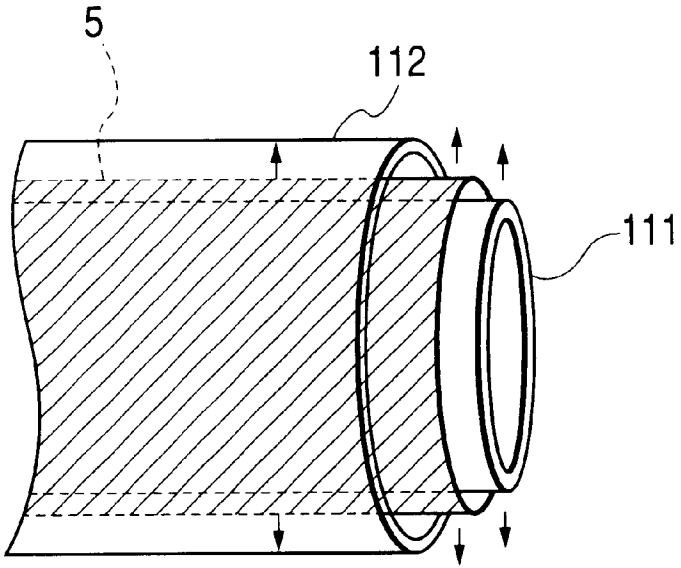

Stated specifically, a method is usable which makes use of a pair of cylindrical forms 111 and 112 as shown in FIGS. 4A and 4B, which are made of materials having different coefficient of thermal expansion and having different diameter. A small-diameter cylindrical form (inner form) 111 has a coefficient of thermal expansion made larger than the coefficient of thermal expansion of a large-diameter cylindrical form (inner form) 112. A tubular film 5 obtained by extrusion is placed over this inner form 111. Thereafter, the inner form 111 with film is inserted into the outer form 112 so that the tubular film 5 is held between the inner form 111 and the outer form 112 (FIG. 4A). A gap between the inner form 111 and the outer form 112 may be determined by calculation on the bases of heating temperature, difference in coefficient of thermal expansion between the inner form 111 and the outer form 112 and pressure required. What has been set in the order of the inner form 111, the tubular film 5 and the outer form 112 is heated to the vicinity of the softening point temperature of resin. As a result of the heating, the inner form 111, having a larger coefficient of thermal expansion, expands more than the outer form 112 and a uniform pressure is applied to the whole tubular film (resin film) 5. Here, the surface of the resin film 5 having reached the vicinity of its softening point is pressed against the inner surface of the outer form 112 having been worked smoothly, so that the smoothness of the surface of the resin film 5 is improved. Thereafter, these are cooled and the film 5 is removed from the forms, thus smooth surface characteristics can be attained (FIG. 4B).

Thereafter, this tubular film 5 is optionally fitted with accessory members such as a reinforcing member, a guide member and a position detection member, and is precisely cut to produce the intermediate transfer belt 5.

Figure 5:
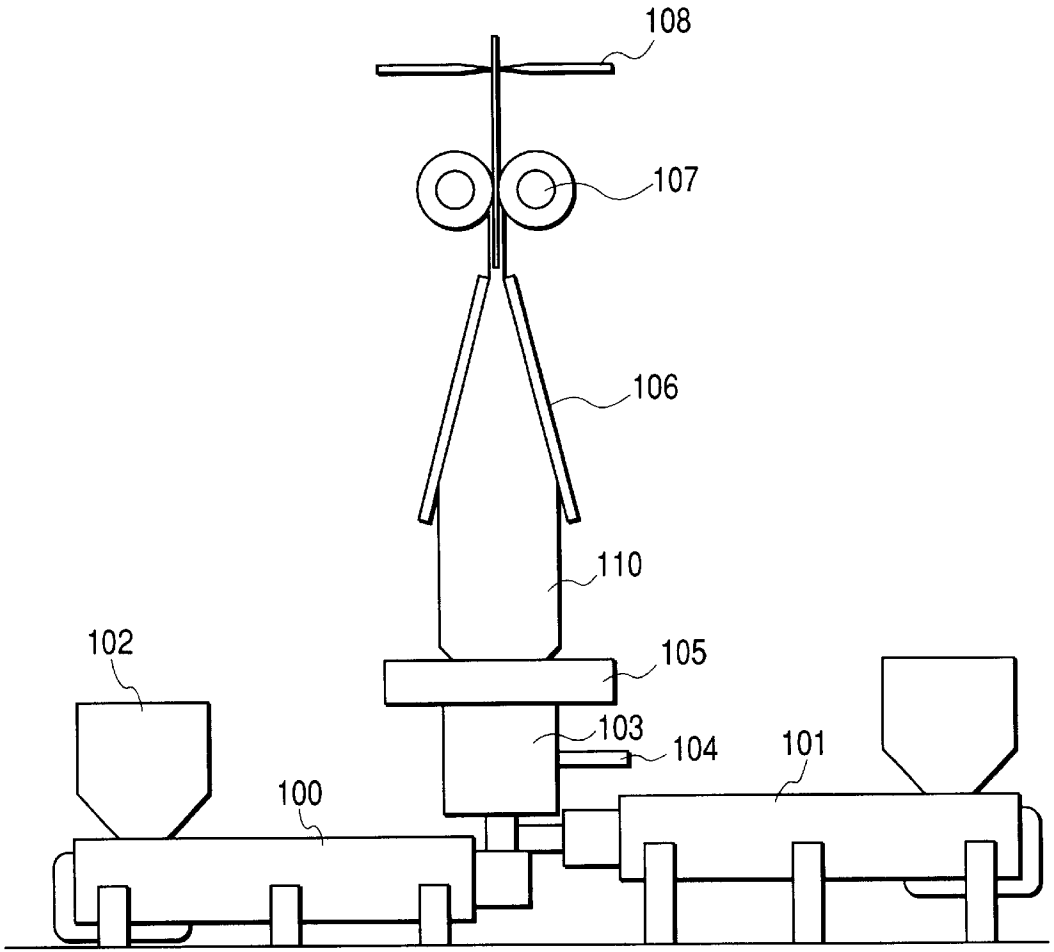
FIG. 5 is a schematic view showing another example of a production unit used to produce the intermediate transfer belt of the present invention.

The foregoing description relates to a single-layer belt. In the case of the endless belt of double-layer construction, an extruder 101 is additionally provided as shown in FIG. 5. Simultaneously with the kneaded melt held in the extruder 100, a kneaded melt in the extruder 101 is sent to a double-layer circular die 103, and the two layers are scale-up inflated simultaneously, thus a double-layer belt can be obtained.

In the case of triple- or more layer construction, the extruder may of course be provided in the number corresponding to the number of layers. Thus, the present invention makes it possible to extrude not only electrophotographic belts of single-layer construction but also those of multi-layer construction in a good dimensional precision through one step and also in a short time. The fact that the extrusion can be made in a short time well suggests that mass production and low-cost production can be made.

The thickness ratio of the extruded tubular film to the circular die 103 in the present invention may be set as the proportion of the thickness of the extruded tubular film to the width of a gap (slit) of the circular die 103. The ratio of the former to the latter may preferably be not larger than ⅓, and particularly preferably not larger than ⅕.

The proportion between the extruded tubular film outer diameter and the circular die diameter is one in which the ratio of the outer diameter of the tubular film 110 to the outer diameter of the die slit of the circular die 103 is expressed by percent. It may preferably be in the range of from 50% to 400%.

These values represent the state of stretch of the material. If the thickness ratio (tubular film thickness/circular die 103 gap) is larger than ⅓, the film may insufficiently stretch to tend to cause difficulties such as low strength, uneven resistance and uneven thickness. As for the ratio of outer diameter of the tubular film to the outer diameter of the die slit of the circular die 103, if it is more than 400%, the film has stretched in excess, making it impossible to ensure the necessary thickness or tending to cause uneven resistance. If on the other hand it is less than 50%, a low extrusion stability may result.

In the present invention, in order to make the intermediate transfer belt/latent-image-bearing member integral cartridge have higher precision, smaller size and lower price, it is also important to select the material and shape of the latent-image-bearing member to be incorporated in the cartridge. In the present invention, the latent-image-bearing member having a cylindrical rigid body as a support is employed. The latent-image-bearing member may preferably have a diameter of 50 mm or less. As stated previously, such a latent-image-bearing member tends to bring about the technical subject of the present invention. However, the construction provided according to the present invention enables settlement of such technical subject.

For the like purpose, the intermediate transfer belt may be of the type it is put over two rollers as in the example shown in FIGS. 1 and 2. This is preferable because the number of component parts can be more cut down and the cartridge can be made more compact.

The tension roller which applies tension to the intermediate transfer belt must slide by at least 1 mm with respect to the direction of elongation of the intermediate transfer belt, in order to deal with any elongation of the intermediate transfer belt. In order for the intermediate transfer belt to be surely driven without slipping, the intermediate transfer belt may preferably be put over the two rollers at a force of 5 N or more.

As mentioned previously, the relationship of characteristics between the intermediate transfer belt 5 and the latent-image-bearing member 1 is influenced by various factors such as the type of resins used in the surface layers of the both, the types of additives, the ratio of quantity of these, the state of dispersion and also the shape. In particular, it is greatly influenced by the types of resins used.

The resins used in the intermediate transfer belt of the present invention and in the latent-image-bearing member may be any of those which can satisfy the characteristics defined in the present invention, without any particular limitation. It is preferable to use at least one of, e.g., olefin resins such as polyethylene and polypropylene, polystyrene resins, polyester resins such as acrylic resin, polyethylene terephthalate and polyarylate, polycarbonate, sulfur-containing resins such as polysulfone, polyether sulfone and polyphenylene sulfide, fluorine-containing resins such as polyvinylidene fluoride and a polyethylene-tetrafluoroethylene copolymer, polyurethane resins, silicone resins, ketone resins, polyvinylidene chloride, thermoplastic polyimide resins, polyamide resins, modified polyphenylene oxide resins, and various modified resins or copolymers of any of these. In particular, the surface layer of the intermediate transfer belt may contain polyvinylidene fluoride resin and the surface layer of the latent-image-bearing member may contain polycarbonate resin or polyarylate resin. This is preferred in view of a high transfer efficiency and a good bias cleaning performance.

There are also no particular limitations on the additives optionally mixed in order to regulate the electrical resistance value of the intermediate transfer belt of the present invention. As a conductive filler for regulating the resistance, it includes carbon black and various conductive metal oxides. As a non-filler type resistance regulator, it includes low-molecular weight ion conducting materials such as various metal salts and glycols, antistatic resins containing an ether linkage or a hydroxyl group in the molecule, and organic high polymers showing electroconductivity. Of these, polyether ester amide resins are preferred in view of the uniformity of resistance.

Other various additives such as a filler, an antioxidant and a nucleating agent may also be added to the intermediate transfer belt of the present invention.

As for the latent-image-bearing member used in the present invention, it is a member having a cylindrical rigid body as its support. Such a support may preferably be made of a metal or alloy such as aluminum or stainless steel.

The latent-image-bearing member used in the present invention may also preferably be an electrophotographic photosensitive member having a photosensitive layer on the support. The photosensitive layer may preferably have a charge transport layer on a charge generation layer. In the present invention, a protective layer may optionally be provided on the charge transport layer.

In the present invention, it is also preferable to use as a cleaning mechanism of the intermediate transfer belt a cleaning-at-primary transfer method (the same meaning as the above "bias cleaning method") in which the transfer residual toner is charged to a polarity reverse to that at the time of primary transfer and returned from the surface of the intermediate transfer belt to the latent-image-bearing member simultaneously with the primary transfer. Stated specifically, it is a means in which electric charges with a polarity reverse to that at the time of primary transfer are imparted to the secondary-transfer residual toner by applying a voltage to a charging member such as a cleaning roller disposed separably on the intermediate transfer belt, and are returned to the latent-image-bearing member by the aid of a primary-transfer electric field at the subsequent primary-transfer zone. As the means by which the transfer residual toner is charged to a reverse polarity, a blade, a corona charging assembly or the like may be used. Any means may be used as long as the electric charges can be imparted to the transfer residual toner remaining on the intermediate transfer belt.

The transfer residual toner returned from the surface of the intermediate transfer belt to the latent-image-bearing member is removed by a cleaning mechanism for the latent-image-bearing member, such as a cleaning blade. This bias cleaning method is greatly effective to make the cartridge compact and low-cost, compared with a method in which cleaning blades or the like and feed mechanisms and containers for waste toner are installed for both the latent-image-bearing member and the intermediate transfer belt.

In order to perform this bias cleaning favorably, it is necessary not only to improve cleaning performance merely, but also to improve primary- and secondary-transfer efficiencies. For that end, it is preferable to select materials with use of which the relationship between the intermediate transfer belt and the latent-image-bearing member satisfy 0 V≦Vt≦100 V.

In the present invention, the intermediate transfer belt 5 and the latent-image-bearing member 1 are integrally set as a cartridge, which, however, may be integral at least at the time they are used by users. Taking account of the handling of these in the course of their manufacture and the readiness to disassemble them after recovery, it is preferred for them to be so designed that they can be divided into some units, e.g., an intermediate transfer belt unit and a latent-image-bearing member unit.

As the cartridge to which the present invention is applied, it is also preferable that the cartridge has at least the intermediate transfer belt and the latent-image-bearing member integrally and in addition thereto the cleaning mechanisms for the intermediate transfer belt and latent-image-bearing member as shown in FIG. 2. The present invention is also applicable to a cartridge having only the cleaning mechanisms for any one of the intermediate transfer belt and the latent-image-bearing member, and to a cartridge having only the intermediate transfer belt and the latent-image-bearing member and having no cleaning mechanism.

Methods for the measurement of various physical properties concerning the present invention are shown below.

(1) Measurement of latent-image-bearing member surface potential when the intermediate transfer belt and the intermediate transfer belt are rubbed with each other:

The intermediate transfer belt and the latent-image-bearing member are incorporated in the intermediate transfer belt/latent-image-bearing member integral cartridge, and vibration in the horizontal direction is continuously applied for 3 minutes at a vibration acceleration of 5 m/sec$^2$, with a vibration waveform of sinusoidal wave and at a frequency of 10 Hz by means of a vibration generator prescribed in JIS Z0232. Immediately thereafter, the surface potential of the part at which the latent-image-bearing member comes into rubbing friction with the intermediate transfer belt is measured with a surface potentiometer MODEL344, manufactured by TREK Co. The measured value obtained is expressed as the latent-image-bearing member surface potential Vt.

In the measurement, the instrument used in measurement, the latent-image-bearing member and the intermediate transfer belt are left for at least 8 hours in an environment of 23±1° C. and 60±5% RH, and the measurement itself is made in the like environment.

(2) Measurement of surface roughness of the intermediate transfer belt: According to JIS B0601.

(3) Measurement of volume resistivity of the intermediate transfer belt:

As measuring equipments, an ultra-high resistance meter R8340A (manufactured by Advantest Co.) is used as a resistance meter, and Sample Box TR42 for ultra-high resistance measurement (manufactured by Advantest Co.) as a sample box. The main electrode is 25 mm in diameter, and the guard-ring electrode is 41 mm in inner diameter and 49 mm in outer diameter.

A sample is prepared in the following way. First, the electrophotographic belt is cut in a circular form of 56 mm in diameter by means of a punching machine or a sharp knife. The circular cut piece obtained is fitted, on its one side, with an electrode over the whole surface by forming a Pt-Pd deposited film and, on the other side, fitted with a main electrode of 25 mm in diameter and a guard electrode of 38 mm in inner diameter and 50 mm in outer diameter by forming Pt-Pd deposited films. The Pt-Pd deposited films are formed by carrying out vacuum deposition for 2 minutes using Mild Sputter E1030 (manufactured by Hitachi Ltd.). The one on which the vacuum deposition has been completed is used as a measuring sample.

Measured in a measurement atmosphere of 23±1° C./60±5% RH. The measuring sample is previously kept left in the like atmosphere for 8 hours or longer. Measurement is made under a mode of discharge for 10 seconds, charge for 30 seconds and measurement for 30 seconds and at an applied voltage of 100 V.

(4) Measurement of thickness:

Thickness unevenness of the intermediate transfer belt of the present invention is measured with dial gauge measurable by 1 μm as minimum value, over the whole periphery of the belt at its position of 50 mm from the both ends and its center position in the peripheral direction at four points at the same intervals. Measurements at the 12 points in total for each intermediate transfer belt are averaged.

In the present invention, the spacer member which may be provided between the intermediate transfer belt and the latent-image-bearing member is to make the latent-image-bearing member have a surface potential Vt of −200 V≦Vt≦200 V when the spacer member and the latent-image-bearing member are rubbed with each other.

Like the relationship between the intermediate transfer belt and the latent-image-bearing member, if the latent-image-bearing member has an absolute value of Vt of more than 200 V, it may change in characteristics to cause density differences in images to be reproduced. The Vt may particularly preferably be −100 V≦Vt≦100 V. It may further preferably be 0 V≦Vt≦100 V from the viewpoint of the selection of materials taking account of good transfer performance and cleaning performance.

In the present invention, what is important is that the relationship of characteristics between the spacer member and the latent-image-bearing member falls within the above range. There are no particular limitations on the means by which it is achieved. As materials used for the spacer member, the materials used in the intermediate transfer belt and latent-image-bearing member are available. In view of keeping the latent-image-bearing member from the unauthorized triboelectric charging as far as possible, the surface layer of the spacer member on its latent-image-bearing member side may preferably be formed using the same material as a binder resin of the surface layer of the latent-image-bearing member. Also, like those described previously, it is preferable that the surface layer of the intermediate transfer belt may contain polyvinylidene fluoride resin, and the surface layer of the spacer member on its latent-image-bearing member side and the surface layer of the latent-image-bearing member may contain polycarbonate resin or polyarylate resin.

As the means for lowering contact pressure of the intermediate transfer belt against the latent-image-bearing member, a method is available in which the tension of the intermediate transfer belt and the contact pressure of the primary-transfer roller are lowered, and a method in which the intermediate transfer belt is set apart from the latent-image-bearing member. From the viewpoint of making the cartridge compact, preferred is the method in which the tension of the intermediate transfer belt and the contact pressure of the primary-transfer roller are lowered. From the viewpoint of surely preventing the latent-image-bearing member from the unauthorized triboelectric charging, preferred is the method in which the intermediate transfer belt is set apart from the latent-image-bearing member.

As described previously, tension is applied to the intermediate transfer belt through the tension roller. Stated more specifically, the tension roller has a sliding mechanism, and is brought into pressure contact with the inside of the belt in the direction of an arrow by the action of a compression spring to impart a tension to the intermediate transfer belt. It may preferably be slidable in a slide width of from 1 to 20 mm, and the spring may preferably apply a pressure of from 5 to 200 N in total.

In the present invention, when the process cartridge is transported, this spring pressure may preferably be set at 1 N or less. Setting the spring pressure at 1 N or less is effective for the latent-image-bearing member to lower the surface potential of the latent-image-bearing member. Also, in such a case, the intermediate transfer belt may preferably be kept apart from the latent-image-bearing member.

The present invention is described below in greater detail by giving Examples.

EXAMPLE 1-1

(1) Production of intermediate transfer belt 5:

| Formulation a: | (by weight) |
|---|---|
| Polyvinylidene fluoride resin (PVDF) | 100 parts |
| Polyether ester amide resin | 12 parts |

1. The above formulation was melt-kneaded at 210° C. by means of a twin-screw extruder to mix the materials, and the mixture obtained was extruded in the shape of a strand of about 2 mm in diameter, followed by cutting into pellets. This is designated as an extrusion material a'.

2. Next, in the extrusion apparatus shown in FIG. 3, the extruder die 103 was set as a single-layer circular die, and one having a die slit outer diameter of 100 mm was used. The die slit was 0.8 mm in width. The above extrusion material a', having been well dried by heating, was put into the hopper 120 of this extrusion apparatus, and heated and melted. The molten product was extruded at 210° C. from the circular die 103. The outside-cooling ring 105 is provided around the circular die 103, and air is blown from the circumference to the film extruded in a tubular form to effect cooling.

3. Air is also blown to the interior of the extruded tubular film through the gas inlet passage 104 to cause the film to inflate while scaling up to have a diameter of 140 mm. Thereafter, the film was continuously drawn off at a constant speed by means of the draw-off unit. Here, the air was stopped being fed at the time the diameter came to the desired value. Subsequent to the draw-off through the pinch rollers, the tubular film was cut with the cutter 108. The film was cut in a length of 310 mm after its thickness came stable to form two tubular films.

4. On these tubular films, their size and surface smoothness were regulated and folds were removed, using the pair of cylindrical forms 111 and 112 shown in FIGS. 4A and 4B, made of metals having different coefficient of thermal expansion. The tubular film were placed over the inner form 111, having a higher coefficient of thermal expansion, and this inner form 111 with film was inserted into the outer form 112 having been worked to have a smooth inner surface, followed by heating at 170° C. for 20 minutes. After cooling, the tubular films were removed from these cylindrical forms, and their ends were cut away, thus two intermediate transfer belts of 140 mm in tube diameter were produced.

5. One of these intermediate transfer belts 5 was left for 24 hours in an environment of 23±1° C. and 60±5%RH, and its various physical properties were measured. As the result, the surface potential Vt of the latent-image-bearing member 1 was found to be +30 V when the intermediate transfer belt 5 and the latent-image-bearing member 1 were rubbed with each other. Also, the surface roughness Ra, wall thickness and volume resistivity of the intermediate transfer belts 5 were 0.04 $\mu$m, 105 $\mu$m, and $5.2\times10^{11}\Omega\cdot$cm, respectively.

(2) Production of latent-image-bearing member 1:

An aluminum cylinder (volume resistivity: $10^{-2}\Omega\cdot$cm) of 47 mm in outer diameter, used as a support, was dip-coated with a 5% methanol solution of a solvent-soluble nylon, followed by drying to provide a subbing layer of 1 $\mu$m thick.

Meanwhile, 10 parts by weight of a bisazo pigment, 5 parts weight of polyvinyl butyral and 50 parts by weight of cylcohexanone were dispersed for 20 hours by means of a sand mill making use of glass beads of 1 mm in diameter. To the dispersion thus formed, 100 parts by weight of methyl ethyl ketone was added to prepare a coating fluid, which was then coated on the subbing layer, followed by drying to form a charge generation layer of about 0.1 $\mu$m in layer thickness.

Next, 10 parts by weight of bisphenol-Z polycarbonate and 10 parts by weight of a hydrazone compound were dissolved in 65 parts by weight of monochlorobenzene to prepare a coating solution, which was then coated on the charge generation layer, followed by drying to form a charge transport layer of 20 $\mu$m in layer thickness, thus a latent-image-bearing member 1 was obtained.

(3) Image print test:

Using the remaining one intermediate transfer belt 5 and the latent-image-bearing member 1, the following test was made as a substitute test for long-term transportation.

The intermediate transfer belt 5 and the latent-image-bearing member 1 were incorporated in the intermediate transfer belt/latent-image-bearing member integral cartridge A shown in FIG. 2, and vibration in the horizontal direction was continuously applied for 3 minutes at a vibration acceleration of 5 m/sec$^2$, with a vibration waveform of sinusoidal wave and at a frequency of 10 Hz by means of the vibration generator prescribed in JIS Z0232. Immediately thereafter, this cartridge was set in the electrophotographic apparatus shown in FIG. 1 to test image reproduction on 80 g/m$^2$ paper.

Here, the tension roller 12 was at a spring pressure of 20 N in total for the right and the left and in an extent of slide of 2.5 mm. The tension roller 12 and the drive roller 8 were each in a diameter of 28 mm. Also, the contact pressure of the primary-transfer roller 6 to the latent-image-bearing member 1 was 0.3 N/cm. The primary-transfer roller 6 was in a diameter of 13 mm.

The electrophotographic apparatus was of a digital laser system with a resolution of 600 dpi. This image print test was made in an environment of 23±1° C. and 60±5%RH. Images obtained were visually evaluated, where uniform images free of any difficulties such as uneven density were obtained on image full pages.

EXAMPLE 1-2

(1) Production of intermediate transfer belt 5:

Two intermediate transfer belts 5 were produced in the same manner as in Example 1-1 except that the formulation was changed to the following formulation b.

| Formulation b: | (by weight) |
|---|---|
| Polyvinylidene fluoride resin (PVDF) | 100 parts |
| Conductive carbon black | 8 parts |

(2) Production of latent-image-bearing member 1:

The same latent-image-bearing member 1 as that in Example 1-1 was used as the latent-image-bearing member 1.

(3) Physical-properties measurement and image print test:

On the intermediate transfer belts 5, physical properties were measured and an image print test was made in the same manner as in Example 1-1. As the result, the surface potential Vt of the latent-image-bearing member 1 was found to be +180 V when the intermediate transfer belt 5 and the latent-image-bearing member 1 were rubbed with each other.

The surface roughness Ra, wall thickness and volume resistivity of the intermediate transfer belt 5 were 0.11 μm, 105 μm and $3.9\times10^{11}\Omega\cdot$cm, respectively.

As the result of the image print test, a very slight unevenness of image density which was considered due to the unauthorized triboelectric charging of the latent-image-bearing member was seen on halftone images.

EXAMPLE 1-3

(1) Production of intermediate transfer belt 5:

Two intermediate transfer belts 5 were produced in the same manner as in Example 1-1 except that the formulation was changed to the following formulation c and the kneading temperature and extrusion temperature were each set to 220° C.

| Formulation c: | (by weight) |
|---|---|
| Amorphous polyamide resin | 100 parts |
| Polyether ester amide resin | 20 parts |

(2) Production of latent-image-bearing member 1:

The same latent-image-bearing member 1 as that in Example 1-1 was used as a latent-image-bearing member 1.

(3) Physical-properties measurement and image print test:

On the intermediate transfer belts 5, physical properties were measured and an image print test was made in the same manner as in Example 1-1. As the result, the surface potential Vt of the latent-image-bearing member 1 was found to be −80 V when the intermediate transfer belt 5 and the latent-image-bearing member 1 were rubbed with each other.

The surface roughness Ra, wall thickness and volume resistivity of the intermediate transfer belt 5 were 0.05 μm, 103 μm and $7.5\times10^{10}\Omega\cdot$cm, respectively.

As the result of the image print test, uniform images free of any difficulties such as uneven density were obtained on image full pages.

EXAMPLE 1-4

(1) Production of intermediate transfer belt 5:

The same intermediate transfer belt 5 as those in Example 1-1 were used as intermediate transfer belts 5.

(2) Production of latent-image-bearing member 1:

A latent-image-bearing member was produced in the same manner as in Example 1-1 except that, as the charge transport layer formed therein, 10 parts by weight of bisphenol-Z polycarbonate, 10 parts by weight of a hydrazone compound and 5 parts by weight of polytetrafluoroethylene resin particles (average particle diameter: 0.2 μm) were dissolved and dispersed in 65 parts by weight of monochlorobenzene to prepare a coating solution, which was then coated on the charge generation layer, followed by drying to form a charge transport layer of 20 μm in layer thickness. Thus, a latent-image-bearing member 1 was obtained.

(3) Physical-properties measurement and image print test:

On the intermediate transfer belts 5 and the latent-image-bearing member 1, physical properties were measured and an image print test was made both in the same manner as in Example 1-1. As the result, the surface potential Vt of the latent-image-bearing member 1 was found to be −170 V when the intermediate transfer belt 5 and the latent-image-bearing member 1 were rubbed with each other.

As the result of the image print test, a very slight unevenness of image density which was considered due to the unauthorized triboelectric charging of the latent-image-bearing member was seen on halftone images.

EXAMPLE 1-5

(1) Production of intermediate transfer belt 5:

Two intermediate transfer belts 5 were produced in the same manner as in Example 1-1 except that the formulation was changed to the following formulation d.

| Formulation d: | (by weight) |
|---|---|
| Polyvinylidene fluoride resin (PVDF) | 91.5 parts |
| Polyether ester amide resin | 8 parts |
| Surface-active agent | 0.5 part |

(2) Production of latent-image-bearing member 1:

a latent-image-bearing member was produced in the same manner as in Example 1-1 except that a hydroxygallium phthalocyanine pigment was used in place of the bisazo pigment to form the charge generation layer, and, as the charge transport layer formed therein, 10 parts by weight of bisphenol-C polyarylate, 9 parts by weight of a stilbene compound and 1 part by weight of a triarylamine compound were dissolved in 65 parts by weight of monochlorobenzene to prepare a coating solution, which was then coated on the charge generation layer, followed by drying to form a charge transport layer of 20 μm in layer thickness. Thus, a latent-image-bearing member 1 was obtained.

(3) Physical-properties measurement and image print test:

On the intermediate transfer belts 5, physical properties were measured and an image print test was made in the same manner as in Example 1-1. As the result, the surface potential Vt of the latent-image-bearing member 1 was found to be +30 V when the intermediate transfer belt 5 and the latent-image-bearing member 1 were rubbed with each other.

The surface roughness Ra, wall thickness and volume resistivity of the intermediate transfer belt 5 were 0.05 μm, 103 μm and $7.5\times10^{10}\Omega\cdot$cm, respectively.

As the result of the image print test, uniform images free of any difficulties such as uneven density were obtained on image full pages.

EXAMPLE 1-6

(1) Production of intermediate transfer belt 5:

Intermediate transfer belts 5 were produced in the same manner as in Example 1-1 except that, among the steps of producing the intermediate transfer belt 5, in the step where the pair of cylindrical forms 111 and 112 constituted of metals having different coefficient of thermal expansion were used, i.e., the step of regulating the size and surface smoothness and removing any folds, a form whose inner surface was finely satin-finished was used as the outer form 112.

(2) Production of latent-image-bearing member 1:

The same latent-image-bearing member 1 as that in Example 1-1 was used as a latent-image-bearing member 1.

(3) Physical-properties measurement and image print test:

On the intermediate transfer belts 5, physical properties were measured and an image print test was made in the same manner as in Example 1-1. As the result, the surface potential Vt of the latent-image-bearing member 1 was found to be +20 V when the intermediate transfer belt 5 and the latent-image-bearing member 1 were rubbed with each other.

The surface roughness Ra, wall thickness and volume resistivity of the intermediate transfer belt 5 were 1.1 $\mu$m, 106 $\mu$m and $6.7\times10^{11}\Omega\cdot$cm, respectively.

As the result of the image print test, very slightly coarse images which were considered due to the roughness of the intermediate transfer belt 5 surface were seen on halftone images.

EXAMPLE 1-7

(1) Production of intermediate transfer belt 5:

The same intermediate transfer belts 5 as those in Example 1-5 were used as intermediate transfer belts 5.

(2) Production of latent-image-bearing member 1:

The same latent-image-bearing member 1 as that in Example 1-5 was used as a latent-image-bearing member 1.

(3) Physical-properties measurement and image print test:

The intermediate transfer belt 5 and the latent-image-bearing member 1 were, like those in Example 1-1, incorporated in the intermediate transfer belt/latent-image-bearing member integral cartridge A shown in FIG. 2, and vibration in the horizontal direction was continuously applied for 3 minutes at a vibration acceleration of 5 m/sec$^2$, with a vibration waveform of sinusoidal wave and at a frequency of 10 Hz by means of the vibration generator prescribed in JIS Z0232. Then the surface potential Vt of the latent-image-bearing member was measured in the same manner as in Example 1-1, except that the spring pressure applied to the tension roller was set at 0.8 N in total.

Figure 8A:
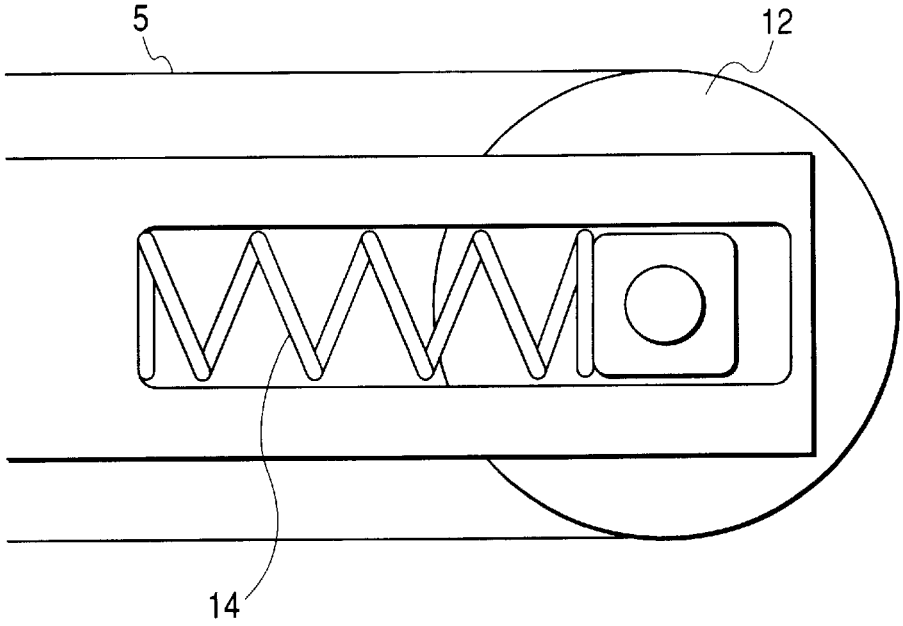
FIGS. 8A and 8B are schematic views showing tension rollers and their vicinity, of process cartridges of Examples 1 to 7 of the present invention.
Figure 8B:
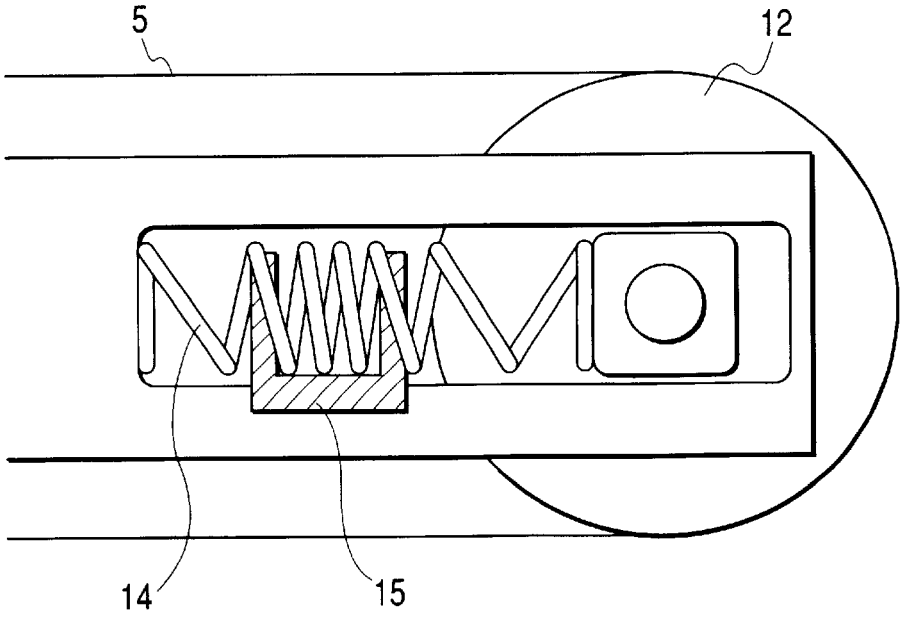

A method of changing the spring pressure is described with reference to FIGS. 8A and 8B. FIG. 8A is a schematic enlarged view of the part of the tension roller and its vicinity, of the intermediate transfer belt/latent-image-bearing member integral cartridge. In contrast thereto, FIG. 8B shows a state in which a spring which applies pressure to a tension roller 12 is fitted with a spring regulation member 15 to compress part of a spring 14 so that the spring acting actually on the tension roller 12 is shortened to make the spring pressure lower than the state shown in FIG. 8A.

As the result, the surface potential Vt of the latent-image-bearing member 1 was found to be 31 95 V. The vibration test was also made in the state the tension roller was fitted with the spring regulation member 15. Thereafter, the spring regulation member 15 was detached so that the spring pressure of the tension roller 12 came to 20 N in total for the right and the left. Thereafter, this cartridge was set in the electrophotographic apparatus shown in FIG. 1 to test image reproduction on 80 g/cm$^2$ paper. As the result, uniform images free of any difficulties such as uneven density were obtained on image full pages.

COMPARATIVE EXAMPLE 1

(1) Production of intermediate transfer belt 5:

Two intermediate transfer belts 5 were produced in the same manner as in Example 1-1 except that the formulation was changed to the following formulation e.

| Formulation e: | (by weight) |
|---|---|
| Ethylene-tetrafluoroethylene resin (ETFE) | 100 parts |
| Conductive carbon black | 7 parts |

(2) Production of latent-image-bearing member 1:

The same latent-image-bearing member 1 as that in Example 1-1 was used as the latent-image-bearing member 1.

(3) Physical-properties measurement and image print test:

On the intermediate transfer belts 5, physical properties were measured and an image print test was made in the same manner as in Example 1-1. As the result, the surface potential Vt of the latent-image-bearing member 1 was found to be +220 V when the intermediate transfer belt 5 and the latent-image-bearing member 1 were rubbed with each other.

The surface roughness Ra, wall thickness and volume resistivity of the intermediate transfer belt 5 were 0.14 $\mu$m, 110 $\mu$m and $7.2\times10^{11}\Omega\cdot$cm, respectively.

As the result of the image print test, a conspicuous unevenness of image density which was considered due to the unauthorized triboelectric charging of the latent-imaging-bearing member 1 was seen on halftone images.

COMPARATIVE EXAMPLE 2

(1) Production of intermediate transfer belt 5:

The same intermediate transfer belts 5 as those in Example 1-3 were used as intermediate transfer belts 5.

(2) Production of latent-image-bearing member 1:

The same latent-image-bearing member 1 as that in Example 1-4 was used as the latent-image-bearing member 1.

(3) Physical-properties measurement and image print test:

On the intermediate transfer belts 5 and the latent-image-bearing member 1, physical properties were measured and an image print test was made both in the same manner as in Example 1-1. As the result, the surface potential Vt of the latent-image-bearing member 1 was found to be −230 V when the intermediate transfer belt 5 and the latent-image-bearing member 1 were rubbed with each other.

As the result of the image print test, a conspicuous unevenness of image density which was considered due to the unauthorized triboelectric charging of the latent-image-bearing member 1 was seen on halftone images.

Compare Examples 1-1 to 1-7 with Comparative Examples 1 and 2 to make examination, the faulty images which do not come into question in Example 1-2, in which the surface potential Vt of the latent-image-bearing member 1 is +180 V when the intermediate transfer belt 5 and the latent-image-bearing member 1 are rubbed with each other under the same conditions, occur in Comparative Example 1, in which the surface potential Vt is +220 V. Similarly, the faulty images which do not come into question in Example 1-4, in which the surface potential Vt of the latent-image-bearing member 1 is −170 V, occur in Comparative Example 2, in which the Vt is −230 V.

From these facts, it has been ascertained that, in the intermediate transfer belt/latent-image-bearing member integral cartridge having the intermediate transfer belt and the latent-image-bearing member integrally in one unit and so constructed as to be detachably mountable to the image-forming apparatus main body, the faulty images caused by any abnormal charging of the latent-imaging-bearing member because of the rubbing friction of the intermediate transfer belt with the latent-image-bearing member during the distribution level of the intermediate transfer belt/latent-image-bearing member integral cartridge can be prevented by making the latent-image-bearing member have a surface potential Vt of $-200\ V \leqq Vt \leqq 200\ V$ when the intermediate transfer belt and the latent-image-bearing member are rubbed with each other. The, Examples 1-1 and 1-2 have proved that better image formation can be performed when the latent-image-bearing member has a surface potential Vt in the range of $-100\ V \leqq Vt \leqq 100\ V$ when the intermediate transfer belt and the latent-image-bearing member are rubbed with each other.

EXAMPLE 2

In Examples 1-1 to 1-7, the faulty images caused by any abnormal charging of the latent-image-bearing member because of the rubbing friction between the intermediate transfer belt and the latent-image-bearing member, and the faulty images in the image-forming apparatus provided with the intermediate transfer belt/latent-image-bearing member integral cartridge can be prevented by making the latent-image-bearing member have a surface potential Vt of $-200\ V \leqq Vt \leqq 200\ V$ when the intermediate transfer belt and the latent-image-bearing member in the intermediate transfer belt/latent-image-bearing member integral cartridge are rubbed with each other. Even where the surface potential Vt of latent-image-bearing member is outside the range of $-200\ V \leqq Vt \leqq 200\ V$ when the intermediate transfer belt and the latent-image-bearing member are rubbed with each other, the problem can also be solved by a method as in this Example.

Figure 6:
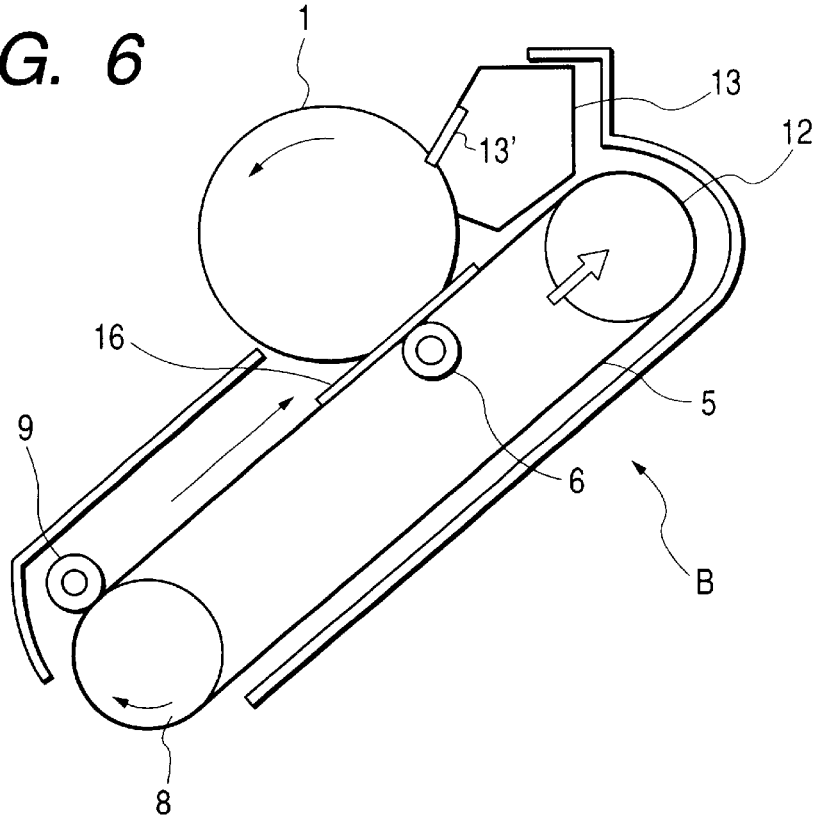
FIG. 6 is a schematic sectional view showing a process cartridge of Example 2 of the present invention.

More specifically, when the intermediate transfer belt/latent-image-bearing member integral cartridge A is transported, as an intermediate transfer belt/latent-image-bearing member integral cartridge B shown in FIG. 6 a spacer member 16 is provided between the intermediate transfer belt 5 and the latent-image-bearing member 1. Then the latent-image-bearing member 1 is made to have a surface potential Vt of $-200\ V \leqq Vt \leqq 200\ V$ when this spacer member 16 and the latent-image-bearing member 1 are rubbed with each other. This method enables prevention of any abnormal charging of the latent-image-bearing member 1 surface which is caused by the vibration applied during transportation and has been a problem peculiar to the intermediate transfer belt/latent-image-bearing member integral cartridge, and enables prevention of any difficulties such that density unevenness occurs in the images to be reproduced.

The intermediate transfer belt/latent-image-bearing member integral cartridge B of this Example, shown in FIG. 6, is the same cartridge as the intermediate transfer belt/latent-image-bearing member integral cartridge. A shown in FIG. 2, except that the spacer member 16 is attached between the intermediate transfer belt 5 and the latent-image-bearing member 1. The production of the intermediate transfer belt 5 and latent-image-bearing member 1 and the measurement of various properties may also be made by the like process and method, provided that, when the surface potential Vt of the latent-image-bearing member 1 is measured, the surface potential Vt of the latent-image-bearing member 1 when the spacer member 16 and the latent-image-bearing member 1 are rubbed with each other is measured, and this Vt is within the range of $-200\ V \leqq Vt \leqq 200\ V$.

Thus, in this Example, the surface potential Vt of the latent-image-bearing member 1 when the intermediate transfer belt 5 and the latent-image-bearing member 1 are rubbed with each other may be outside the range of $-200\ V \leqq Vt \leqq 200\ V$ without any problem.

EXAMPLE 2-1

(1) Production of intermediate transfer belt 5:

The same intermediate transfer belts 5 as those in Comparative Example 1 were used as intermediate transfer belts 5.

(2) Production of latent-image-bearing member 1:

The same latent-image-bearing member 1 as that in Comparative Example 1 was used as a latent-image-bearing member 1.

(3) Spacer member 16:

A resin film made of bisphenol-A polycarbonate was used as the spacer member 16.

(4) Physical-properties measurement:

The intermediate transfer belt 5, the latent-image-bearing member 1 and the spacer member 16 were incorporated in the intermediate transfer belt/latent-image-bearing member integral cartridge B shown in FIG. 6, and physical properties were measured in the same manner as in Example 1-1. As the result, the surface potential Vt of the latent-image-bearing member 1 was found to be +30 V when the spacer member 16 and the latent-image-bearing member 1 were rubbed with each other.

(5) Image print test:

Using these intermediate transfer belt 5, latent-image-bearing member 1 and spacer member 16, the following test was made as a substitute test for long-term transportation.

The intermediate transfer belt 5, the latent-image-bearing member 1 and the spacer member 16 were incorporated in the intermediate transfer belt/latent-image-bearing member integral cartridge B shown in FIG. 6, and vibration in the horizontal direction was continuously applied for 3 minutes at a vibration acceleration of 5 $m/sec^2$, with a vibration waveform of sinusoidal wave and at a frequency of 10 Hz by means of the vibration generator prescribed in JIS Z0232. Immediately thereafter, the spacer member 16 was pulled out and this cartridge was set in the electrophotographic apparatus shown in FIG. 1 to test image reproduction in the same manner as in Example 1-1. This image reproduction was tested in an environment of 23±1° C. and 60±5%RH.

As the result, uniform images free of any difficulties such as uneven density were obtained on image full pages.

In this Example, since the intermediate transfer belt 5 and the latent-image-bearing member 1 are the same as those in Comparative Example 1 given above, the surface potential Vt of the latent-image-bearing member 1 is +220 V when the intermediate transfer belt 5 and the latent-image-bearing member 1 are rubbed with each other, and are outside the range of $-200\ V \leqq Vt \leqq 200\ V$.

As can be seen from these facts, even where the surface potential Vt of latent-image-bearing member is outside the range of −200 V≦Vt≦200 V when the intermediate transfer belt and the latent-image bearing member are rubbed with each other, the problem can be solved by making the latent-image-bearing member have a surface potential Vt of −200 V≦Vt≦200 V when the spacer member and the latent-image-bearing member are rubbed with each other.

EXAMPLE 3

Even where the surface potential Vt of latent-image-bearing member is outside the range of −200 V≦Vt≦200 V when the intermediate transfer belt and the latent-image-bearing member are rubbed with each other, the problem can also be solved by a method as in this Example, which is a method other than the method making use of the spacer member 16 as described in Example 2-1.

Figure 7:
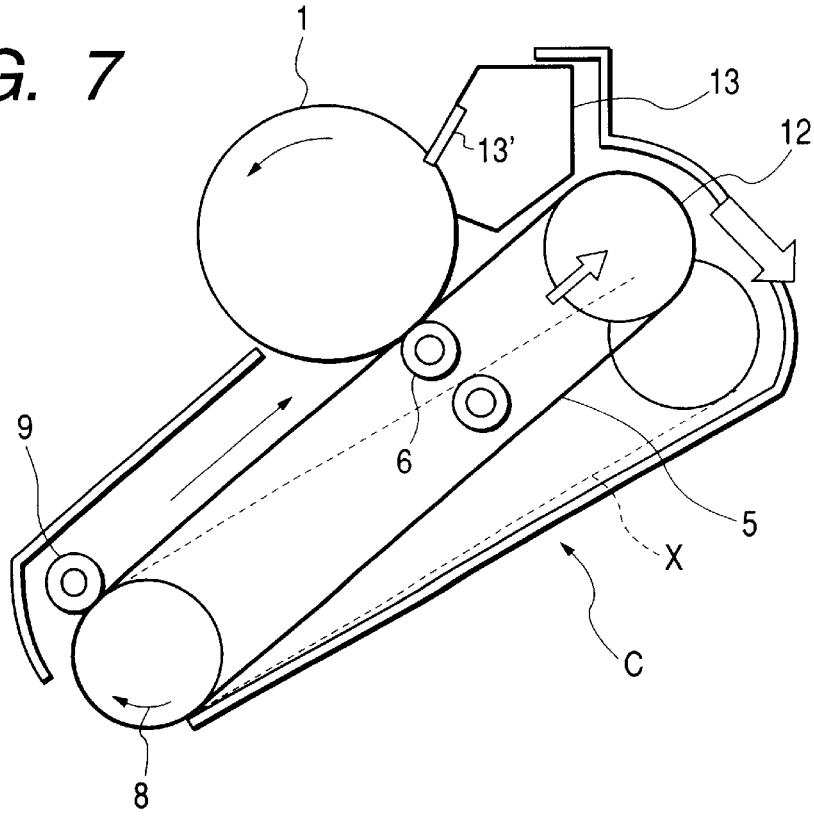
FIG. 7 is a schematic sectional view showing a process cartridge of Example 3 of the present invention.

More specifically, as shown in FIG. 7, the intermediate transfer belt/latent-image-bearing member integral cartridge A is so constructed that the intermediate transfer belt 5 and the latent-image-bearing member 1 are separable, to provide an intermediate transfer belt/latent-image-bearing member integral cartridge C. Thus, when the intermediate transfer belt/latent-image-bearing member integral cartridge C is transported, at least the intermediate transfer belt 5 and the latent-image-bearing member 1 are kept apart from each other (a state X shown in FIG. 7). This method enables, when the intermediate transfer belt/latent-image-bearing method integral cartridge C is transported, prevention of any abnormal charging of the latent-image-bearing member 1 surface which is caused by the vibration applied during transportation and has been a problem peculiar to the intermediate transfer belt/latent-image-bearing member integral cartridge, and enables prevention of any difficulties such that density unevenness occurs in images to be reproduced.

The intermediate transfer belt/latent-image-bearing member integral cartridge C of this Example, shown in FIG. 7, is the same cartridge as the cartridge A shown in FIG. 2, except that the intermediate transfer belt 5 and the latent-image-bearing member 1 are kept apart from each other during distribution in the market. The production of the intermediate transfer belt 5 and latent-image-bearing member 1 and the measurement of various properties may also be made by the like process and method, provided that, when the surface potential Vt of the latent-image-bearing member 1 is measured, the surface potential Vt of the latent-image-bearing member 1 in the state wherein the intermediate transfer belt 5 and the latent-image-bearing member 1 are kept apart from each other is determined by measuring the surface potential Vt of the latent-image-bearing member 1 after the vibration has been applied thereto under the vibration conditions described previously.

Thus, in this Example, the surface potential Vt of the latent-image-bearing member 1 when the intermediate transfer belt 5 and the latent-image-bearing member 1 are rubbed with each other may be outside the range of −200 V≦Vt≦200 V without any problem.

EXAMPLE 3-1

(1) Production of intermediate transfer belt 5:

The same intermediate transfer belts 5 as those in Comparative Example 2 were used as intermediate transfer belts 5.

(2) Production of latent-image-bearing member 1:

The same latent-image-bearing member 1 as that in Comparative Example 2 was used as a latent-image-bearing member 1.

(3) Physical-properties measurement:

The intermediate transfer belt 5 and the latent-image-bearing member 1 were incorporated in the intermediate transfer belt/latent-image-bearing member integral cartridge C shown in FIG. 7. This cartridge was vibrated in the same manner as in Example 1-1 but in the state the intermediate transfer belt 5 and the latent-image-bearing member 1 were kept apart from each other, and then the surface potential Vt of the latent-image-bearing member 1 was measured. As the result, the surface potential Vt of the latent-image-bearing member 1 was found to be 0 V.

(4) Image print test:

Using these intermediate transfer belt 5 and latent-image-bearing member 1, the following test was made as a substitute test for long-term transportation.

The intermediate transfer belt 5 and the latent-image-bearing member 1 were incorporated in the intermediate transfer belt/latent-image-bearing member integral cartridge C shown in FIG. 7, having a mechanism with which the latent-image-bearing member 1 and the intermediate transfer belt 5 can be set apart from each other. In the state the latent-image-bearing member 1 and the intermediate transfer belt 5 were kept apart from each other, the vibration was applied thereto in the same manner as in Example 1-1. Thereafter, the image reproduction was tested.

As the result, uniform images free of any difficulties such as uneven density were obtained on image full pages.

In this Example, since the intermediate transfer belt 5 and the latent-image-bearing member 1 are the same as those in Comparative Example 2 given above, the surface potential Vt of the latent-image-bearing member 1 is −230 V when the intermediate transfer belt 5 and the latent-image-bearing member 1 are rubbed with each other, and are outside the range of −200 V≦Vt≦200 V.

As can be seen from these facts, even where the surface potential Vt of latent-image-bearing member is outside the range of −200 V≦Vt≦200 V when the intermediate transfer belt and the latent-image-bearing member are rubbed with each other, the problem can be solved by the method as in this Example, in which at least the intermediate transfer belt and the latent-image-bearing member are kept apart from each other when the intermediate transfer belt/latent-image-bearing member integral cartridge C is transported.

The use of the intermediate transfer belt/latent-image-bearing member integral cartridge described in Examples 2-1 and 3-1 enables achievement of the object of the present invention, and makes it possible to select materials for the intermediate transfer belt and latent-image-bearing member over a wide range.

Incidentally, as the intermediate transfer belt according to the present invention, the beltlike, intermediate transfer belt described in Examples 1-1 to 1-7 is preferred in view of the miniaturization and cost reduction of the apparatus, but the shape of the intermediate transfer member is by no means limited to this.

As described above, according to the present invention, any abnormal charging of the latent-image-bearing member because of the mutual rubbing of the latent-image-bearing member and intermediate transfer belt can be prevented, which is caused by vibration when the process cartridge having the intermediate transfer belt and the latent-image-bearing member integrally in one unit and so constructed as to be detachably mountable to the image-forming apparatus main body is transported or left over a long period of time. On account of such an advantage, when the process cartridge is provided in the image-forming apparatus, good images can be obtained, maintenance can be performed with ease, and the miniaturization and cost reduction of the apparatus can be achieved.

What is claimed is:

1. A process cartridge which is detachably mountable to a main body of an image-forming apparatus, said process cartridge integrally comprising:

a latent-image-bearing member having a cylindrical rigid body as a support, on the surface of which an electrostatic latent image is formed, the electrostatic latent image being developable to form a toner image; and an intermediate transfer belt to which the toner image formed on said latent-image-bearing member is primarily transferred and on which the toner image is held and transported to transfer the toner image secondarily to a transfer medium;

said latent-image-bearing member having a surface potential Vt of $-200\ V \leqq Vt \leqq 200\ V$ when said intermediate transfer belt and said latent-image-bearing member are rubbed with each other.

2. A process cartridge according to claim 1, wherein Vt is in the following range: $-100\ V \leqq Vt \leqq 100\ V$.

3. A process cartridge according to claim 2, wherein Vt is in the following range: $0\ V \leqq Vt \leqq 100\ V$.

4. A process cartridge according to claim 1, wherein said latent-image-bearing member has an outer diameter of 50 mm or less.

5. A process cartridge according to claim 1, wherein said intermediate transfer belt has a volume resistivity of from $10^6 \Omega \cdot cm$ to $8 \times 10^{13} \Omega \cdot cm$.

6. A process cartridge according to claim 1, wherein said intermediate transfer belt has a surface roughness Ra of 1 $\mu$m or less.

7. A process cartridge according to claim 1, wherein said intermediate transfer belt has a surface layer containing a polyvinylidene fluoride resin, and said latent-image-bearing member has a surface layer containing a polycarbonate resin or a polyarylate resin.

8. A process cartridge according to claim 7, wherein said surface layer of said intermediate transfer belt further contains a polyether ester amide resin.

9. A process cartridge according to claim 1, which further comprises means for charging a transfer residual toner to a polarity reverse to that at the time of a primary transfer, and wherein the transfer residual toner is returned to said latent-image-bearing member at the time of the primary transfer.

10. A process cartridge according to claim 1, further comprising a primary-transfer roller, in contact with said latent-image-bearing member at a contact pressure of from 0.01 N/cm to 1 N/cm.

11. A process cartridge according to claim 1, wherein tension is applied by a spring to said intermediate transfer belt, and the spring is at a pressure of from 5 N to 200 N in total.

12. A process cartridge according to claim 1, wherein said image-forming apparatus employs a digital system with a resolution of 600 dpi or more.

13. A process cartridge which is detachably mountable to a main body of an image-forming apparatus, said process cartridge integrally comprising:

a latent-image-bearing member having a cylindrical rigid body as a support, on the surface of which an electrostatic latent image is formed, the electrostatic latent image being developable to form a toner image; and an intermediate transfer belt to which the toner image formed on said latent-image-bearing member is primarily transferred and on which the toner image is held and transported to transfer the toner image secondarily to a transfer medium; and a spacer member being provided between said intermediate transfer belt and said latent-image-bearing member, said latent-image-bearing member having a surface potential Vt of $-200\ V \leqq Vt \leqq 200\ V$ when said spacer member and said latent-image-bearing member are rubbed with each other.

14. A process cartridge according to claim 13, wherein Vt is in the following range: $-100\ V \leqq Vt \leqq 100\ V$.

15. A process cartridge according to claim 14, wherein Vt is in the following range: $0\ V \leqq Vt \leqq 100\ V$.

16. A process cartridge according to claim 13, wherein said latent-image-bearing member has an outer diameter of 50 mm or less.

17. A process cartridge according to claim 13, wherein said spacer member has on the latent-image-bearing member side thereof a surface layer containing the same resin as a resin contained in a surface layer of said latent-image-bearing member.

18. A process cartridge which is detachably mountable to a main body of an image-forming apparatus, said process cartridge integrally comprising:

a latent-image-bearing member having a cylindrical rigid body as a support, on the surface of which an electrostatic latent image is formed, wherein the electrostatic latent image is developable to form a toner image; and an intermediate transfer belt to which the toner image formed on said latent-image-bearing member is primarily transferred and on which the toner image is held and transported to transfer the toner image secondarily to a transfer medium;

said process cartridge having means for lowering contact pressure of said intermediate transfer belt against said latent-image-bearing member, to lower the contact pressure of said intermediate transfer belt against said latent-image-bearing member when said process cartridge is transported.

19. A process cartridge according to claim 18, wherein said intermediate transfer belt is kept apart from said latent-image-bearing member when the process cartridge is transported.

20. An image-forming apparatus comprising a process cartridge which is detachably mountable to a main body of an image-forming apparatus and which integrally supports therein:

a latent-image-bearing member having a cylindrical rigid body as a support, on the surface of which an electrostatic latent image is formed, wherein the electrostatic latent image is developable to form a toner image; and an intermediate transfer belt to which the toner image formed on said latent-image-bearing member is primarily transferred and on which the toner image is held and transported to transfer the toner image secondarily to a transfer medium; and said latent-image-bearing member having a surface potential Vt of $-200\ V \leqq Vt \leqq 200\ V$ when said intermediate transfer belt and said latent-image-bearing member are rubbed with each other.

21. An image-forming apparatus comprising a process cartridge which is detachably mountable to a main body of an image-forming apparatus and which integrally supports therein:

a latent-image-bearing member having a cylindrical rigid body as a support, on the surface of which an electrostatic latent image is formed, wherein the electrostatic latent image is developable to form a toner image; and an intermediate transfer belt to which the toner image formed on said latent-image-bearing member is primarily transferred and on which the toner image is held and transported to transfer the toner image secondarily to a transfer medium; and a spacer member being provided between said intermediate transfer belt and said latent-image-bearing member, said latent-image-bearing member having a surface potential Vt of $-200\ V \leqq Vt \leqq 200\ V$ when the spacer member and said latent-image-bearing member are rubbed with each other.

22. An image-forming apparatus comprising a process cartridge which is detachably mountable to a main body of an image-forming apparatus and which integrally supports therein:

a latent-image-bearing member having a cylindrical rigid body as a support, on the surface of which an electrostatic latent image is formed, wherein the electrostatic latent image is developable to form a toner image; and an intermediate transfer belt to which the toner image formed on said latent-image-bearing member is primarily transferred and on which the toner image is held and transported to transfer the toner image secondarily to a transfer medium; and said process cartridge having means for lowering contact pressure of said intermediate transfer belt against said latent-image-bearing member, to lower the contact pressure of said intermediate transfer belt against said latent-image-bearing member when said process cartridge is transported.

23. An intermediate transfer belt for a process cartridge which is detachably mountable to a main body of an image-forming apparatus and which integrally supports therein: a latent-image-bearing member having a cylindrical rigid body as a support, on the surface of which an electrostatic latent image is formed, wherein the electrostatic latent image is developable to form a toner image wherein said intermediate transfer belt receives through a primary transfer operation from the latent-image-bearing member the toner image, wherein said intermediate transfer belt holds and transports the received toner image to transfer the toner image secondarily to a transfer medium; and the latent-image-bearing member has a surface potential Vt of $-200\ V \leqq Vt \leqq 200\ V$ when said intermediate transfer belt and the latent-image-bearing member are rubbed with each other.

* * * * *

UNITED STATES PATENT AND TRADEMARK OFFICE

CERTIFICATE OF CORRECTION

PATENT NO. : 6,775,494 B2
DATED : August 10, 2004
INVENTOR(S) : Takashi Kusaba et al.

It is certified that error appears in the above-identified patent and that said Letters Patent is hereby corrected as shown below:

Column 1,
Line 47, “indispensable” should read -- required --.

Column 6,
Line 25, “any” should be deleted.

Column 7,
Line 12, “though-pat” should read -- throughput --.

Column 9,
Line 56, “uniformly” should read -- uniformly in --.

Column 13,
Line 52, “equipments,” should read -- equipment, --

Column 14,
Line 6, “kept left” should read -- left --.

Column 18,
Line 35, “a” should read -- A --.

Column 19,
Line 60, “31 95 V.” should read -- -95V. --.

Column 28,
Line 10, “therein:” should read -- therein --.

Signed and Sealed this

Twenty-eighth Day of December, 2004

JON W. DUDAS
*Director of the United States Patent and Trademark Office*